US007555819B2

(12) United States Patent
Wensley

(10) Patent No.: US 7,555,819 B2
(45) Date of Patent: Jul. 7, 2009

(54) COFFIN

(75) Inventor: Philip Wensley, Totnes (GB)

(73) Assignee: Devoncraft UK, Ltd., Devon (GB)

( * ) Notice: Subject to any disclaimer, the term of this patent is extended or adjusted under 35 U.S.C. 154(b) by 22 days.

(21) Appl. No.: 11/835,805

(22) Filed: Aug. 8, 2007

(65) Prior Publication Data

US 2008/0034562 A1 Feb. 14, 2008

(30) Foreign Application Priority Data

Aug. 9, 2006 (GB) ..... 0615783.8

(51) Int. Cl.
*A61G 17/00* (2006.01)

(52) U.S. Cl. ..... 27/3; 27/2; 27/17; 27/19

(58) Field of Classification Search ..... 27/2–4, 27/14, 17, 19, DIG. 1; D99/1, 3; 220/9.1, 220/9.4

See application file for complete search history.

(56) References Cited

U.S. PATENT DOCUMENTS 1,381,908 A * 6/1921 Downer ..... 27/7
1,587,257 A * 6/1926 Van Alstine ..... 27/7
1,708,443 A 4/1929 Fifer
1,965,385 A * 7/1934 Ludwig ..... 27/6
2,524,402 A * 10/1950 Slaughter, Jr. et al. ..... 27/17
2,836,876 A * 6/1958 Ziegler ..... 27/6

FOREIGN PATENT DOCUMENTS

DE 19818558 A 10/1999
EP 1625840 A2 2/2006
EP 1625840 A3 2/2006

OTHER PUBLICATIONS

Naturalendings; http://www.naturalendings.co.uk/Willow-Bamboo-Coffins-Buy.htm.
Search Report dated Nov. 9, 2006, in priority Application No. GB0615783.8.

* cited by examiner

*Primary Examiner*—William L. Miller
(74) *Attorney, Agent, or Firm*—Young Law Firm, P.C.

(57) ABSTRACT

A coffin comprises a frame and a cover layer formed from a plurality of strands of a first material interlaced with a plurality of strands of a second material. The cover layer is attached to the frame by the second material to form a recess for receiving a cadaver. The cover layer is a woven cover layer comprising weft strands formed of the first material warp strands formed of the second material. Each of a plurality of the strands of the second material pass through at least one through hole provided in the frame, thereby to secure the cover layer to the frame.

14 Claims, 5 Drawing Sheets

COFFIN

CROSS-REFERENCE TO RELATED APPLICATIONS

This application claims foreign priority benefits under 35 U.S.C. §119(a)-(d), on Great Britain Patent Application No. GB 0615783.8, filed Aug. 9, 2006.

BACKGROUND OF THE INVENTION

Field of the Invention

The present invention relates to a coffin. Ecologically friendly coffins fabricated from biodegradable materials are well known. Such coffins often comprise a woven structure formed in a similar manner to a wicker basket or the like. However, the structure of currently available biodegradable coffins, and in particular woven coffins, is particularly flexible. The sides of the coffin are prone to flex inwardly when pushed from the side thereby giving a general perception of weakness. Additionally, in extreme circumstances there can be a tendency for the coffin to sag, for example when carrying a heavy body. Furthermore, the handles for such coffins, result in significant localised strain on the woven walls of the coffin, thereby leading to a risk of the handles breaking through the wall while the coffin is being lifted.

The present invention relates to a coffin, which mitigates the above issues without the need to use metallic or other non-biodegradable fixings.

According to the present invention there is provided, a coffin comprising: a frame; a cover layer formed from a plurality of strands of a first material interlaced with a plurality of strands of a second material; wherein said cover layer is attached to said frame by said second material to form a recess for receiving a cadaver.

Preferable features of the coffin are set out in the dependent claims.

BRIEF DESCRIPTION OF THE DRAWINGS

The invention will now be described by way of example only with reference to the attached figures in which.

SUMMARY

An embodiment of the present invention is a coffin that may include a frame and a cover layer formed from a plurality of strands of a first material interlaced with a plurality of strands of a second material. The cover layer may be attached to the frame by the second material to form a recess for receiving a cadaver. The first and second flexible materials may be different. The first flexible material may include banana leaf. For example, the second flexible material may include Rattan, Raffia, Sisal, Jute, Agol, Vetiver, Ulap, Doya, Pandanus, Mendong, Wicker, Bamboo, Seagrass, Willow, and/or Water Hyacinth. The cover layer may be a woven cover layer comprising weft strands formed of the first material. The cover layer may be a woven cover layer comprising warp strands formed of the second material. Each of the plurality of the strands of the second material pass through one or more through holes provided in the frame, thereby to secure the cover layer to the frame. The coffin may include a lid, and the frame may include a rebate for receiving the lid, and the lid and the rebate may be mutually engageable to close the recess. The lid may be securable in the rebate using a plurality of fixing means. The lid may include a plurality of fixing apertures, and the rebate may include a plurality of threaded recess. Each recess may be located for alignment with a corresponding aperture when the lid is engaged in the rebate, for receiving a corresponding attachment means, thereby to secure the lid in place. Each the attachment means each may include a wooden screw. Each wooden screw may include a handgrip for manual tightening and loosening. The lid may include a woven layer of the first and second materials. The coffin may further include carrying means arranged such that the weight of the coffin and any cadaver therein is transferred to the carrying means without significant force being applied to the cover layer. The carrying means may be arranged such that the weight of the coffin and any cadaver therein is transferred to the carrying means through the frame.

DETAILED DESCRIPTION

Figure 1:
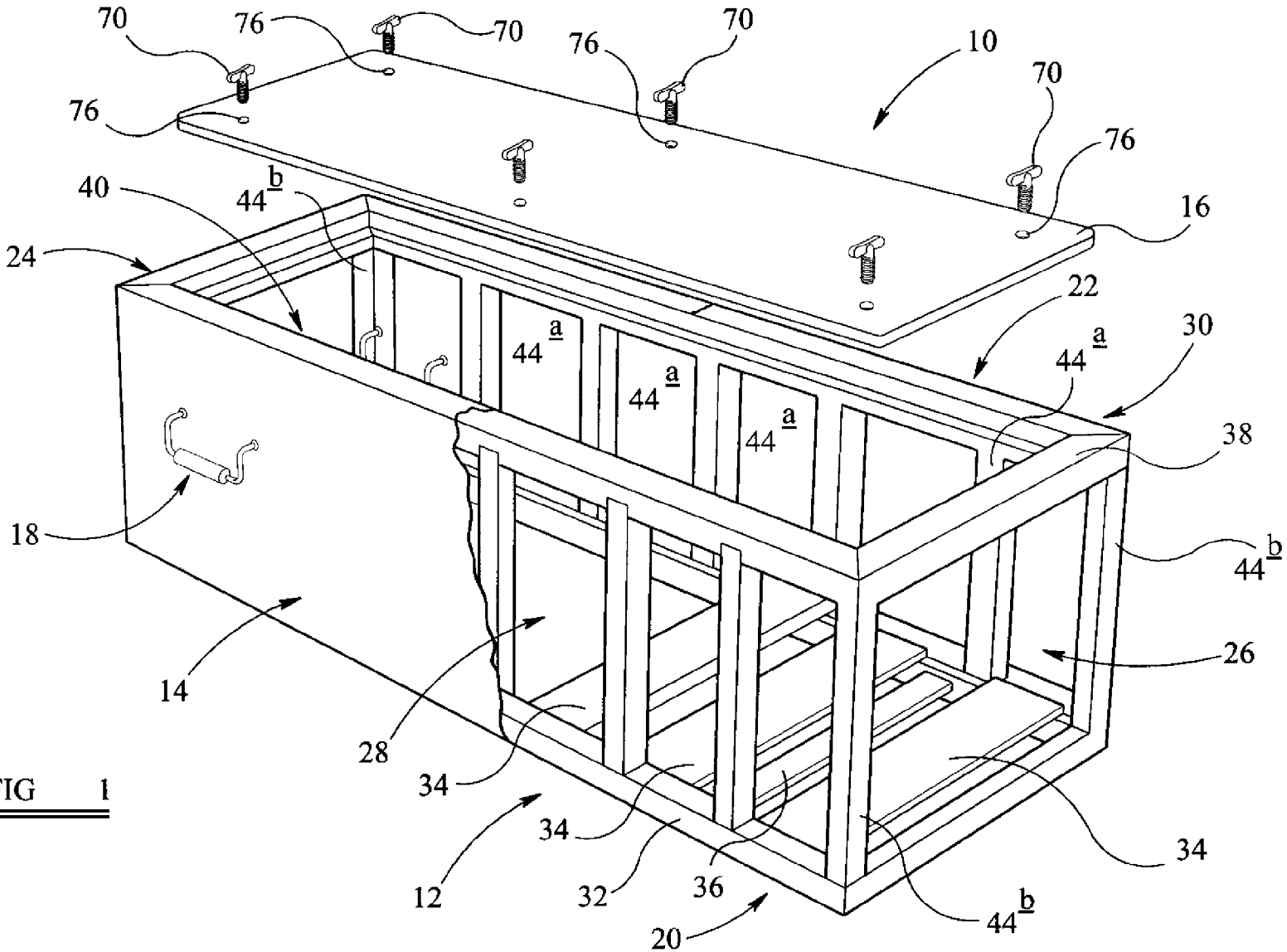
FIG. 1 shows a first coffin according to the invention with a cutaway cover layer.

In FIG. 1 a simple coffin is shown generally at 10. The coffin comprises a main frame 12, a cover layer 14, a lid 16, and carrying means 18 all formed from suitable biodegradable materials. It will be appreciated that throughout the description orientation specific terms such as vertical, upper, top and the like relate to the orientation of the coffin as seen in the figures.

The cover layer 14 comprises a flexible layer attached to the outside of the main frame 12 to form a generally box shaped structure having an internal recess for receiving a cadaver. The frame 12 with the cover layer 14 attached, and the lid 14, are configured for mutual engagement to close the coffin 10 in operation when a cadaver is located in the coffin. The carrying means 18 comprises a plurality of carrying handles (only one of which is shown) located at suitable locations on each side of the coffin.

The main frame 12 comprises an open, generally rectangular rigid structure having a base portion 20, an upper portion 22, two end portions 24, 26, and two side portions 28, 30, arranged to form the general shape of a simple rectangular coffin 10. It will be appreciated that any suitable shape of coffin is possible, for example, a coffin with a single rounded end as discussed later with reference to FIG. 2, a coffin with both ends rounded, or a traditionally shaped 'six-sided' coffin.

The base portion 20 comprises an elongate base frame 32 forming the perimeter of the coffin base. In the embodiment shown in FIG. 1 the base frame 32 is generally rectangular in shape. The base frame may comprise any suitable material of any suitable dimensions but typically comprises lengths of rectangular/square cross-section wood of sufficient thickness to provide the structural integrity required for supporting a cadaver (for example, 30 mm×30 mm in cross-section).

A plurality of base panels 34, are located transversely across the base frame 32 for supporting the cadaver. Each end of each panel is rebated into the base frame 32 such that the panel 34 lies substantially flush with an upper surface of the base frame 32. The base panels 34 may comprise any suitable material of any suitable dimensions but typically comprise wooden or wood based board panels sufficiently thick to support the cadaver, and sufficiently thin to be rebated into, and supported by the base frame 32 (for example, 15 mm thick).

The base portion 20 is further provided with a plurality of cross-supports 36 located transversely across the base frame 32 for providing transverse structural support. The cross-supports 36 and the panels 34 are arranged alternately in the longitudinal direction, although it will be appreciated that many other suitable configurations are possible. The cross-supports 36 may comprise any suitable material of any suitable dimensions, but typically comprise lengths of rectangular/square cross-section wood, which is thicker than the panels 34 but thinner than the material of the base frame (for example, 30 mm×20 mm in cross-section).

The upper portion 22 comprises an elongate top frame 38 forming the perimeter of an opening 40 for receiving the cadaver. The top frame 38 has the same external shape and dimensions as the base frame 32, and includes a lip 42 projecting inwardly to the opening 40. The lip 42 extends from the bottom of the top frame 38 to form a generally 'L' shaped cross-section around the full perimeter of the opening thereby forming a recessed section/rebate for receiving the lid 16 in operation. The recess/rebate is configured such that the lid 16 lies substantially flush with the top of the main frame 12 and cover layer 14, when the lid 16 is in place.

It will be appreciated that, the top of the 'L' shape cross-section of the top frame 38 may be curved to provide an associated curved look when the cover layer 14 is in place.

It will be appreciated that the lip 42 may alternatively comprise a plurality of sections which do not extend the full perimeter, but which are of suitable length and arrangement to support the lid 16. The top frame 38 may comprise any suitable material of any suitable dimensions, but typically comprises lengths of wood arranged to form the 'L' shaped cross-section, and of sufficient thickness to provide the structural integrity required for supporting a cadaver.

A plurality of generally vertical uprights 44*a* and 44*b* connect the top frame 38 to the base frame 32 around their perimeters, for structural integrity. Each end of each upright is jointed to the corresponding frame 32, 38, using any suitable means, for example, a halving joint or the like. For ease of construction, each joint with the top frame 38 is made with an external side of the frame 38 for simplicity. Whilst an internal joint is possible, the presence of the lip 42 makes such a joint less practical. Any perceived negative visual effect arising from having joints showing externally, is mitigated because the cover layer 14 hides the joints when the coffin is fully assembled.

Each joint with the base frame 32 is made with an internal side of the frame 32, although external jointing is also possible.

The uprights 44*a* and 44*b* include a plurality of generally equi-spaced side uprights 44*a*, connecting respective transverse sides of the base and top frames 32, 38, and four corner uprights 44*b* connecting corresponding corners of the base and top frames 32, 38 respectively.

The side uprights 44*a*, corner uprights 44*b* and the respective transverse sides of the base and top frames 32, 38, form the corresponding side portions 28, 30. Similarly, the corner uprights 44*b* and respective longitudinal ends of the base and top frames 32, 38, form the corresponding end portions 24, 26.

It will be appreciated that there may be any suitable number of uprights including, for example, additional uprights connecting respective longitudinal ends of the base and top frames 32, 38. Furthermore, the uprights need not be vertical, for example some or all the uprights may be angled relative to the vertical to connect base and top frames of different sizes and/or shapes, and/or to provide additional structural integrity.

The uprights may comprise any suitable material of any suitable dimensions, but typically comprise lengths of square/rectangular or other cross-section wood of sufficient thickness to provide the structural integrity required for supporting a cadaver. It will be appreciated that although use of the same material has manufacturing advantages, the uprights need not all have the same cross-section. Each corner upright 44*b* may, for example, have a quarter circle cross-section, the curved surface facing outwardly from the main frame 12 to provide an associated curved look when the cover layer 14 is in place. In such a case the corners of the top and base frames would be similarly curved. Furthermore, some of the uprights, for example the corner and/or the central side uprights, may have a larger cross-section to provide additional structural integrity.

Figure 2:
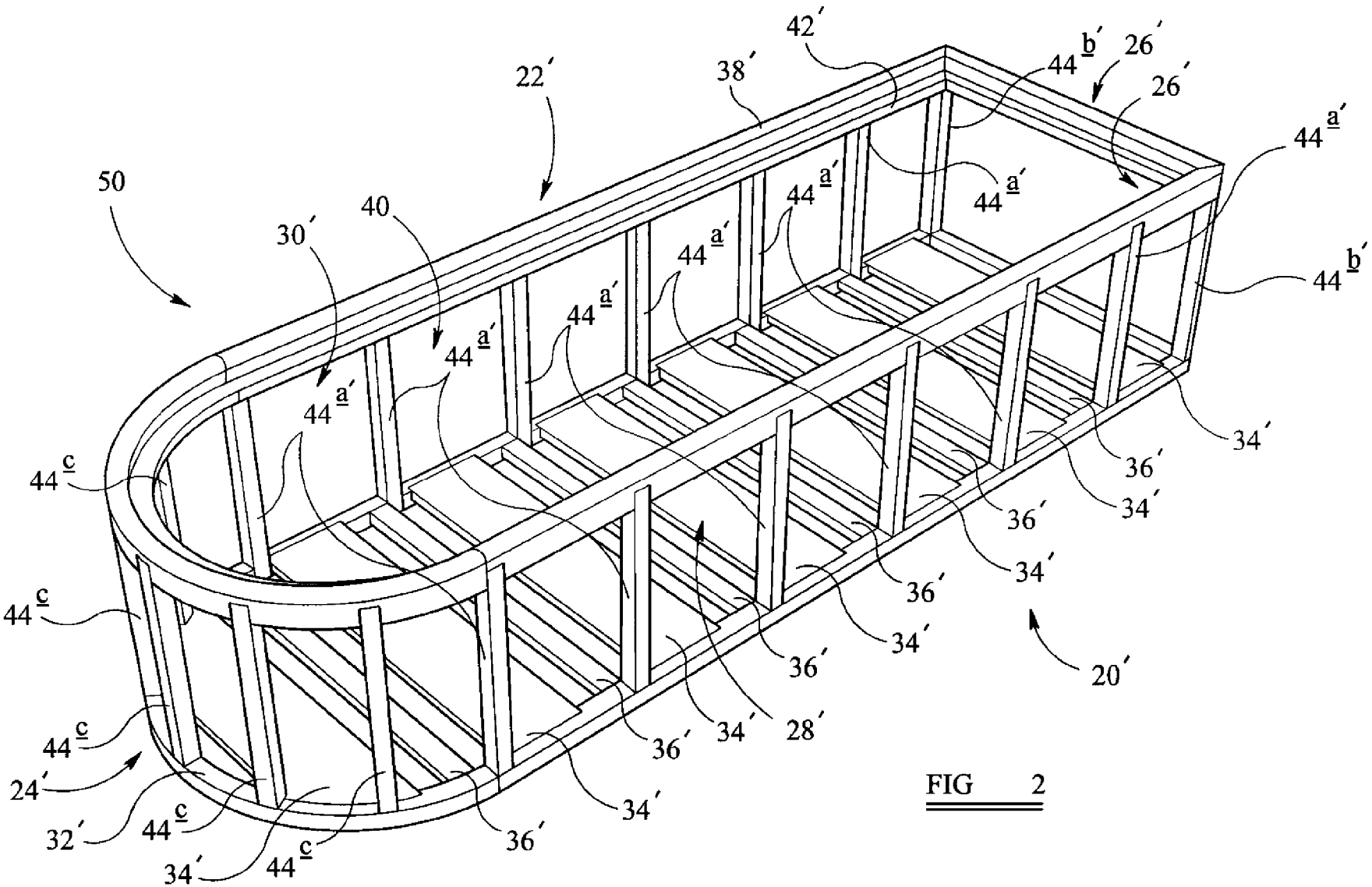
FIG. 2 shows a frame of a second coffin according to the invention.

FIG. 2 shows a similar frame for a second embodiment of a coffin generally at 20. The frame 50 is generally similar to the main frame 12 shown in FIG. 1 and corresponding parts have like reference numerals with an additional prime.

Like the frame 12, the main frame 50 comprises an open, rigid structure having a base portion 20', an upper portion 22', two end portions 24', 26', and two side portions 28', 30'. The frame 50 is, however, arranged to form the general shape of a coffin 10 having an arcuate end portion 24' corresponding to the end of the coffin at which the head of a cadaver is positioned in use.

The base and upper portions 20', 22' are comprise base and top frames 32', 38' respectively as generally described with reference to FIG. 1. The frames are not, however, rectangular but each have an arcuate end portion for the formation of the corresponding end portion 24' of the main frame 12, the other longitudinal end of the base and top frames 32', 38' is substantially straight.

A plurality of base panels 34', are located transversely across the base frame 32' for supporting the cadaver. Each end of each panel is rebated into the base frame 32' such that the panel 34' lies substantially flush with an upper surface of the base frame 32'.

The base portion 20' is further provided with a plurality of cross-supports 36' located transversely across the base frame 32' for providing transverse structural support. The cross-supports 36' and the panels 34' are arranged alternately in the longitudinal direction, although it will be appreciated that many other suitable configurations are possible.

The top frame 38' has the same external shape and dimensions as the base frame 32', and includes a lip 42' projecting inwardly to the opening 40'. The lip 42' extends from the bottom of the top frame 38' to form a generally 'L' shaped cross-section around the full perimeter of the opening thereby forming a recessed section/rebate for receiving the lid in operation. The recess/rebate is configured such that the lid lies substantially flush with the top of the main frame 12' and cover layer 14', when the lid is in place.

The top of the 'L' shape cross-section of the top frame 38' is curved to provide an associated curved look when the cover layer 14' is in place. The curve may be of any suitable radius.

A plurality of generally vertical uprights 44*a*', 44*b*', 44*c*, connect the top frame 38' to the base frame 32' around their perimeters, for structural integrity. Each end of each upright is jointed to the corresponding frame 32', 38', using any suitable means, for example, a halving joint or the like. For ease of construction, each joint with the top frame 38' is made with an external side of the frame 38' for simplicity. Whilst an internal joint is possible, the presence of the lip 42' makes such a joint less practical. Any perceived negative visual effect arising from having joints showing externally, is mitigated because the cover layer 14 hides the joints when the coffin is fully assembled.

Each joint with the base frame 32' is made with an internal side of the frame 32', although external jointing is also possible.

The uprights 44*a*', 44*b*', 44*c* include: a plurality of generally equi-spaced side uprights 44*a*', connecting respective transverse sides of the base and top frames 32', 38'; two corner uprights 44*b*' connecting corresponding corners of the straight ends of the base and top frames 32', 38' respectively; and a plurality of end uprights 44*c* connecting the respective arcuate ends of the base and top frames 32', 38'.

The side uprights 44*a*', corner uprights 44*b*' and the respective transverse sides of the base and top frames 32', 38', form the corresponding side portions 28', 30'. The corner uprights 44*b*' and straight ends of the base and top frames 32', 38', form the corresponding end portion 26'. The end uprights 44*c* and arcuate end of the base and top frames 32', 38', form the corresponding arcuate end portion 24'.

It will be appreciated that the general description of the frame 12 and possible alternatives applies equally to the frame 50, other than where specific differences have been highlighted.

It will be appreciated that the component parts of the coffin may comprise any suitable material, or combination of materials. Typically, for example, the main frame 12 is fabricated from wood, and the cover layer 14 and lid 16 from woven layers of natural flexible material such as a natural grass or the like. The woven layers may, for example comprise banana leaf woven with one or more other natural materials such as Rattan, Raffia, Sisal, Jute, Agol, Vetiver, Ulap, Doya, Pandanus, Mendong, Wicker, Willow, Bamboo, Seagrass, and/or Water Hyacinth. The lid 16 may also comprise an internal rigid frame of wood or the like.

Figure 3A:
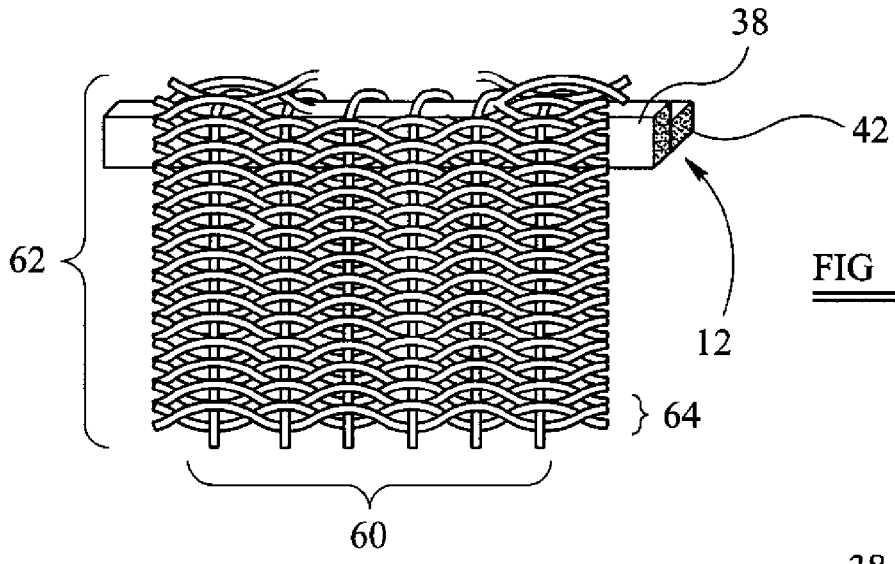
FIG. 3*a* shows a partial section of a cover layer for the coffin of FIG. 1 or FIG. 2 from a first aspect.
Figure 3B:
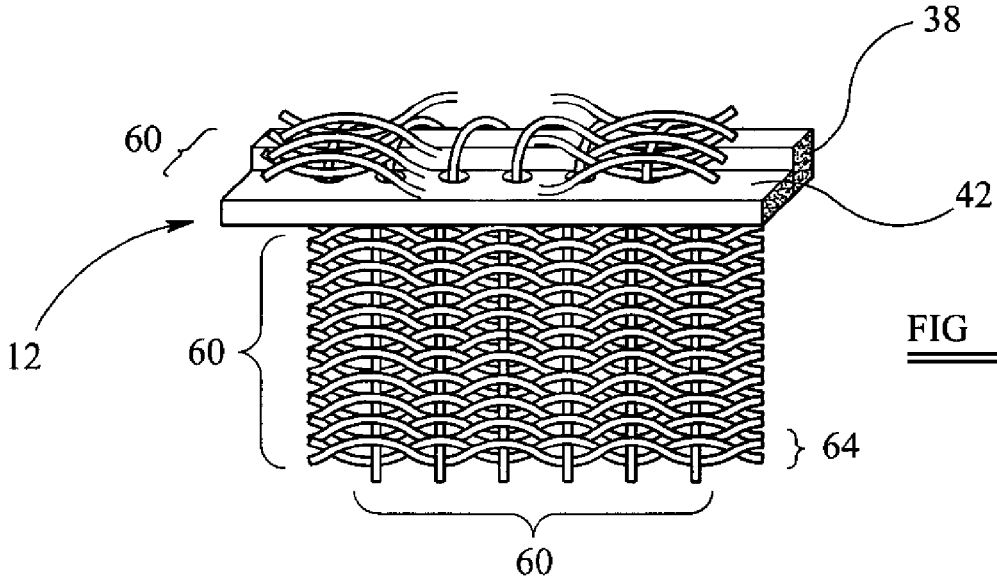
FIG. 3*b* shows a partial section of a cover layer for the coffin of FIG. 1 or FIG. 2 from a second aspect.

FIGS. 3*a* and 3*b* show front and rear views of a partial section of the cover layer 14 in position attached to a portion of the frame 12. It will be appreciated that the description of the cover layer 14 and the way it is attached to the frame 12 is equally applicable to the frame 50 described with reference to FIG. 2.

The cover layer comprises a plurality of warp strands 60, and a plurality of weft or woof strands 62 interlaced together to form the cover layer 14 in situ on the frame. For the purposes of clarity the term warp strands refers to generally parallel strands that are strung to form a foundation onto which weft strands are woven. The term weft or woof strands refer to strands, which are interlaced with, the warp strands.

Each weft strand 62 is woven alternately on either side of the warp strands 60 in known fashion to form a generally weft faced cover layer 14. The weft strands 62 are located in pairs 62', each strand of each pair 62' being woven on the opposite side of each warp strand 60 compared to the other strand of the pair 62'. The strands of each pair 62' are also twisted with one another.

The weft strands 62 run generally perpendicular to the warp strands 60. It will be appreciated that other weaving methods may be used, for example an angled weave relative to the perpendicular, to give a different weave pattern.

The warp and weft strands 60, 62 may comprise any suitable material but typically the warp strands comprise a natural grass such as Rattan, or the like, and the weft strands comprise another natural flexible material such as banana leaf, or the like. It will be appreciated that the weft and warp strands may be of the same material.

As best seen in FIG. 3*b* the lip 42 of the top frame is provided with a plurality of generally vertical through holes 64 for allowing the warp strands 60, and hence the cover layer 14, to be secured to the main frame 12. The holes are located close to the intersection with the upright portion of the 'L' shaped cross-section. Each top-frame hole is provided with a similar through holes (not shown) located horizontally through the base frame 32, directly below it. Each hole in one transverse side of the base and top frames 32 is aligned with a corresponding hole through the other transverse side.

Figure 3C:
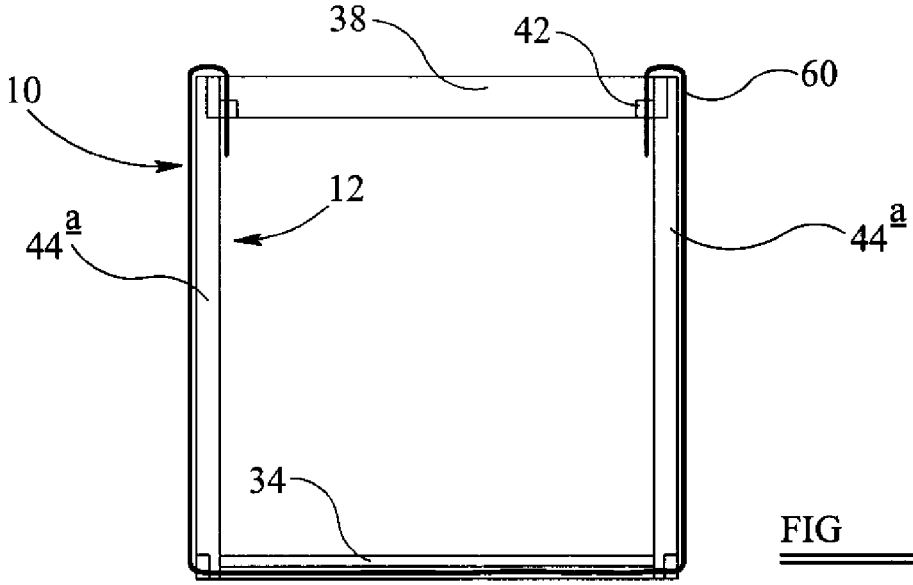
FIG. 3*c* shows a simplified cross-section of a frame for the coffin of FIG. 1 or FIG. 2, illustrating the location of warp strands of the cover layer on said frame.

With reference to FIGS. 3*b* and 3*c* each warp strand 60 forming the cover layer over the transverse sides of the coffin, is threaded upwardly through a corresponding hole 64 in one side of the top frame 38. The warp strand 60 then passes over the top of 'L' shaped cross-section as seen in FIG. 3*c* vertically downwardly toward the corresponding through holes in the transverse side of the base frame. The warp strand 60 is threaded through the horizontal hole, transversely across the base frame 32, and through the aligned through hole in the opposite side. From there the warp strand 60 passes vertically upwardly, over the top frame 38 and then downwardly again through the through hole transversely opposite the first. Hence, the warp strands 60 form a plurality of generally 'U' shaped formations transversely across the main frame 12, as seen in FIG. 3*c*.

The warp strands 60 may be secured below each through hole in the lip by any suitable means to attach the warp strand to the main frame 12. Alternatively or additionally all or some of the warp strands 60 may be formed from a single length of the warp material, the material passing from one completed 'U' formation, to a longitudinally adjacent through hole in the top frame 38, for the formation of the adjacent 'U' shape.

It will be appreciated that warp strands 60 are also provided at the longitudinal ends of the main frame 12 and may be secured in a similar fashion to those at the sides.

Referring back to FIG. 1, the lid 16 is configured for mutual engagement in the recess formed by the 'L' shape cross-section of the top frame 38 and the cover layer 14. The lid 14 comprises a woven structure formed by a plurality of weft strands woven into a plurality of warp strands in a similar manner to that described for the cover layer. The 14 lid may be formed as a purely woven structure, or alternatively as a woven lid cover layer attached to a lid frame made of wood or the like.

Figure 4:
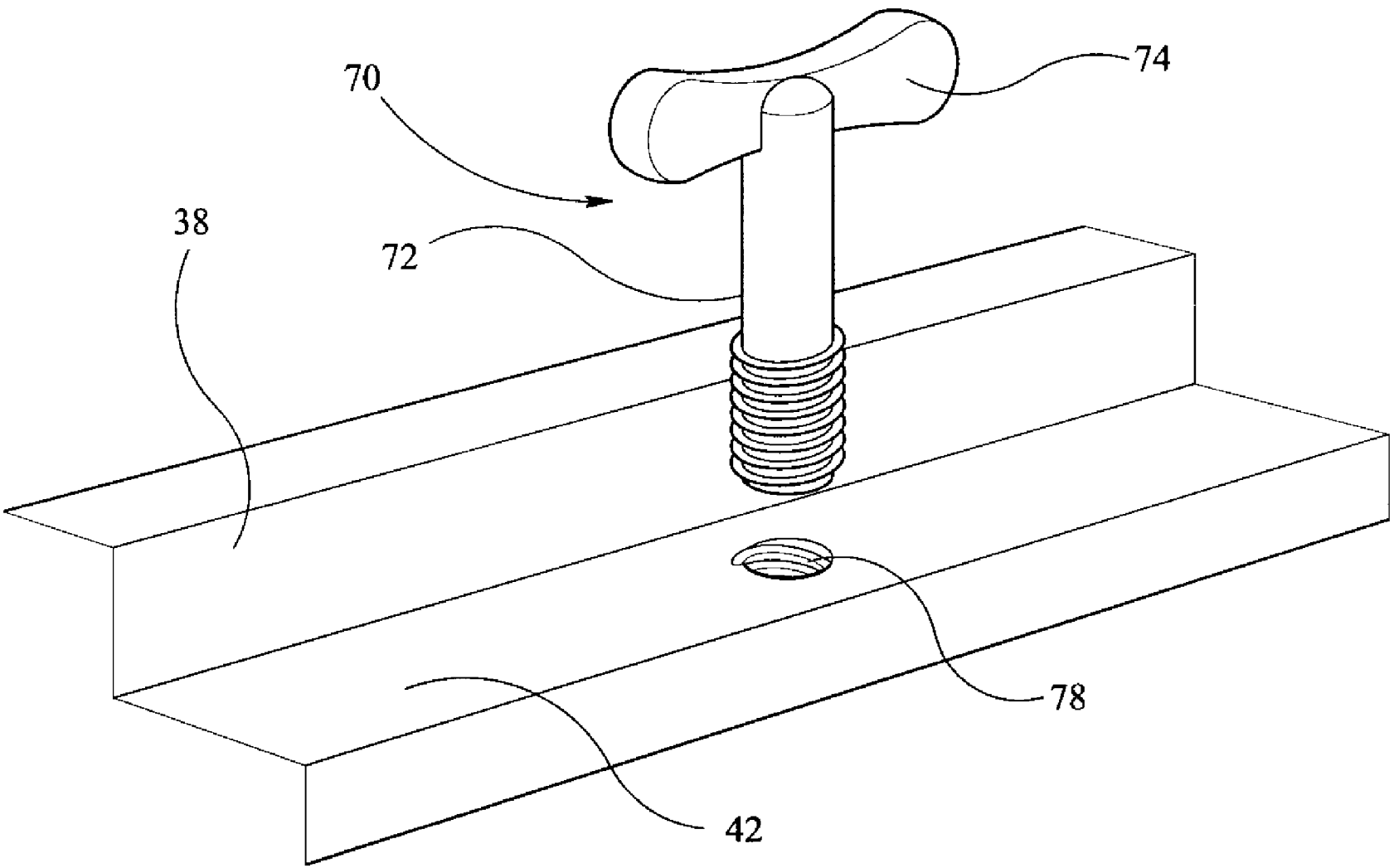
FIG. 4 shows a partial close-up view of lid attachment means for the coffin of FIG. 1 or FIG. 2.

As seen in FIGS. 1 and 4, the lid 16 is provided with a plurality of attachment means 70 for securing the lid into the rebate formed in the top frame 38. For simplicity, the lid 16 is not shown in FIG. 4. Each attachment means 70 comprises a manual bolt or screw having a threaded shank 72 and a handgrip 74, to allow the bolt or screw to be turned by hand. A plurality of through holes 76 are provided in the lid, through which the shank 72 of a corresponding attachment means may be received in operation. A plurality of corresponding threaded recesses 78 are provided in the lip 42 of the top frame 38 for threaded engagement with the threaded shank 72 of the attachment means. Each threaded recess 78 is located for alignment with a corresponding through hole 76 in the lid 16, when the lid is engaged in the rebate, for receiving a corresponding attachment means thereby to secure said lid in place.

Hence, in operation, when the lid is engaged in the recess it can be secured in place by manually screwing the attachment means through the through hole 76 in the lid, and into the threaded recess 78. The attachment means may comprise any suitable material but are typically made from a biodegradable material such as wood.

Figure 5:
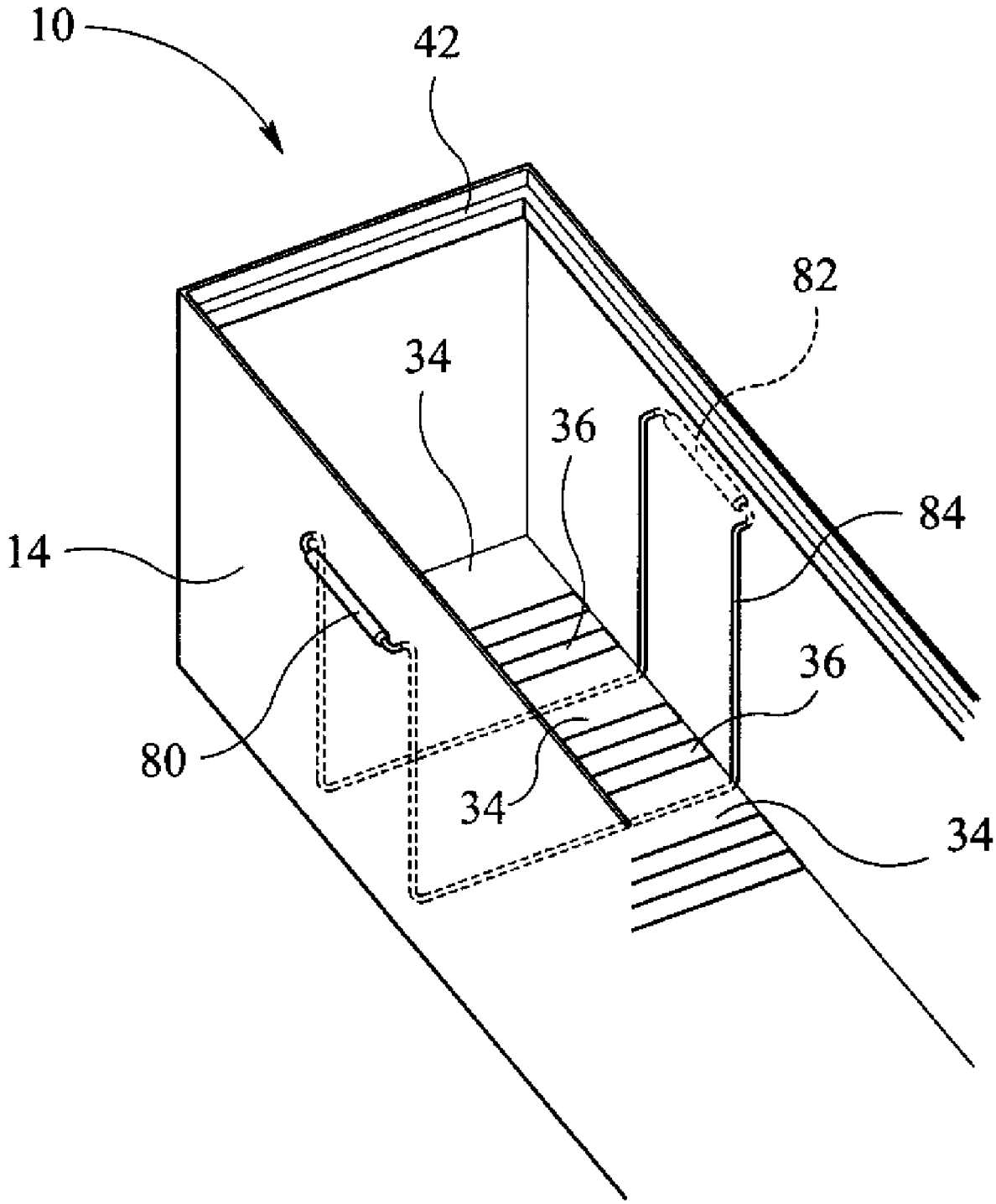
FIG. 5 shows a partial close-up view of carrying means for the coffin of FIG. 1 or FIG. 2.

As seen in FIGS. 1 and 5, the carrying means 18 comprises a pair of carrying handles 80, 82 located in transverse alignment, externally on opposite sides of the coffin 10, and towards one longitudinal end. For simplicity, the frame in FIG. 5 is not shown in detail. The carrying means further comprises at least one further pair of carrying handles (not shown) located in transverse alignment, externally on opposite sides of the coffin 10, and towards the other longitudinal end. It will be appreciated that further pairs of carrying handles may be provided at suitable locations, for example towards the longitudinal centre of the coffin 10.

Each carrying handle 80, 82, comprises a generally tubular wooden handgrip threaded onto a biodegradable rope 84, formed into a loop. The handgrips 80, 82 of each transversely aligned pair of handles are threaded onto the same loop. The loop is arranged such that the rope 84 passes through a first of the handgrips 80, and then through a first aperture provided in the cover layer 14, below the lip, into the coffin. The rope 84 then passes downwardly to the base frame 32, where it extends transversely across the coffin 10, between the base frame 32 and the cover layer 14, to the opposite side. On the opposite side of the coffin 10, the rope 84 extends upwardly to and through a second aperture provided in the cover layer 14. The rope then passes through the second of the handgrips 82 forming the pair, before passing through a third aperture in the cover layer 14 back into the coffin 10.

After re-entering the coffin, the rope 84 passes downwardly to the base frame 32, once again, where it extends transversely across the coffin 10, beneath the base frame, and back to the original side. On the original side of the coffin 10 the rope 84 extends upwardly to and through a fourth aperture provided in the cover layer 14.

The first, second, third and fourth apertures are arranged at the corners of an imaginary rectangle extending transversely across the coffin 10 parallel to the base of the coffin 10.

Thus, in operation, when the coffin 10 is carried using the carrying handles, the weight of the cadaver and the coffin is transferred through the frame 12, directly to the rope 84, and the carrying handles. Hence, the woven cover layer 14 does not need to take a significant weight.

What is claimed is:

1. A coffin for receiving a cadaver comprising:

a frame;

a cover layer formed from a plurality of strands of a first material interlaced with a plurality of strands of a second material, strands of said second material passing through at least one through hole provided in said frame, thereby to secure said cover layer to said frame;

wherein said cover layer is attached to said frame by said second material to form a recess for receiving the cadaver, and a lid for closing.

2. A coffin as claimed in claim 1, wherein said first and second flexible materials are different.

3. A coffin as claimed in claim 1, wherein said first flexible material comprises banana leaf.

4. A coffin as claimed in claim 1, wherein said second flexible material comprises one of Rattan, Raffia, Sisal, Jute, Agol, Vetiver, Ulap, Doya, Pandanus, Mendong, Wicker, Bamboo, Seagrass, Willow, or Water Hyacinth.

5. A coffin as claimed in claim 1, wherein said cover layer is a woven cover layer comprising weft strands formed of said first material.

6. A coffin as claimed in claim 1, wherein said cover layer is a woven cover layer comprising warp strands formed of said second material.

7. A coffin as claimed in claim 1, wherein said frame comprises a rebate for receiving said lid, said lid and said rebate being mutually engageable to close said recess.

8. A coffin as claimed in claim 7, wherein said lid is securable in said rebate using a plurality of attachment means.

9. A coffin as claimed in claim 8, wherein said lid comprises a plurality of fixing apertures, and said rebate comprises a plurality of threaded recess; and wherein each recess is located for alignment with a corresponding aperture when said lid is engaged in said rebate, for receiving a corresponding attachment means thereby to secure said lid in place.

10. A coffin as claimed in claim 9, wherein each said attachment means each comprises a wooden screw.

11. A coffin as claimed in claim 10, wherein each wooden screw comprises a handgrip for manual tightening and loosening.

12. A coffin as claimed in claim 1, wherein said lid comprises a woven layer of said first and second materials.

13. A coffin as claimed in claim 1 further comprising carrying means arranged such that the weight of the coffin and any cadaver therein is transferred to the carrying means without significant force being applied to the cover layer.

14. A coffin as claimed in claim 13 wherein the carrying means is arranged such that the weight of the coffin and any cadaver therein is transferred to the carrying means through the frame.

* * * * *